US012331608B2

(12) United States Patent
Reid

(10) Patent No.: US 12,331,608 B2
(45) Date of Patent: Jun. 17, 2025

(54) LINEAR ESCAPEMENT FOR A SUBTERRANEAN VALVE

(71) Applicant: Halliburton Energy Services, Inc., Houston, TX (US)

(72) Inventor: Michael Reid, Aberdeenshire (GB)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/757,259

(22) Filed: Jun. 27, 2024

(65) Prior Publication Data

US 2024/0384615 A1 Nov. 21, 2024

Related U.S. Application Data

(63) Continuation of application No. 18/198,351, filed on May 17, 2023, now Pat. No. 12,049,794.

(51) Int. Cl.
*E21B 23/04* (2006.01)
*E21B 34/14* (2006.01)

(52) U.S. Cl.
CPC ..... *E21B 23/04* (2013.01); *E21B 34/14* (2013.01)

(58) Field of Classification Search
CPC ..... E21B 34/14; E21B 23/14
See application file for complete search history.

(56) References Cited

U.S. PATENT DOCUMENTS 6,433,991 B1 8/2002 Deaton et al.
7,971,652 B2 7/2011 Tanju
2009/0229814 A1 9/2009 Going, III
2013/0056220 A1 3/2013 Sommers et al.
2014/0299319 A1* 10/2014 Pabon ..... E21B 41/00 166/207
2015/0226033 A1 8/2015 Inglis
2015/0247380 A1* 9/2015 Avery ..... E21B 33/124 166/185
2016/0032684 A1 2/2016 Shkurti et al.
(Continued)

FOREIGN PATENT DOCUMENTS

CN 109505547 B 8/2019
WO 2014204474 A1 12/2014
WO 2022104019 A1 5/2022

OTHER PUBLICATIONS

Netherlands Search Report and Written Opinion for NL Patent Application No. 2037392 dated Aug. 14, 2024. English Machine Translation, PDF file. 8 pages.
(Continued)

*Primary Examiner* — Dany E Akakpo
(74) *Attorney, Agent, or Firm* — Scott Richardson; C. Tumey Law Group PLLC

(57) ABSTRACT

A linear escapement mechanism is provided for actuating a downhole tool in a controlled and predictable manner, such as in response to a certain number of pressure cycles. In an example, the actuator includes an escapement sleeve moveable with respect to an actuator housing. The escapement sleeve has a plurality of escapement teeth. A rocker secured within the actuator housing has opposing first and second pallets. An operating sleeve is reciprocable to rock the rocker back and forth to alternately move the opposing first and second pallets into engagement with the escapement sleeve as the escapement sleeve advances in an actuating direction.

20 Claims, 6 Drawing Sheets

(56) References Cited

U.S. PATENT DOCUMENTS

| | | | |
|---|---|---|---|
| 2016/0003005 | A1 | 6/2016 | Pickle et al. |
| 2016/0356121 | A1 | 12/2016 | Hill, Jr. et al. |
| 2017/0275967 | A1 | 9/2017 | Sargent et al. |
| 2018/0274330 | A1 | 9/2018 | Sim et al. |
| 2021/0032653 | A1 | 2/2021 | Dietrich et al. |

OTHER PUBLICATIONS

International Search Report and Written Opinion for International Patent Application No. PCT/US2023/025021 dated Feb. 8, 2024.
Notice of Allowance for U.S. Appl. No. 18/198,351 dated Apr. 3, 2024.

* cited by examiner

LINEAR ESCAPEMENT FOR A SUBTERRANEAN VALVE

CROSS REFERENCE TO RELATED APPLICATIONS

This application is a continuation of U.S. patent application Ser. No. 18/198,351, filed May 17, 2014, which is incorporated by reference in its entirety.

BACKGROUND

Hydrocarbons, such as oil and gas, can be recovered from an underground formation with a hydrocarbon recovery well. Constructing such a well typically involves drilling a wellbore from a surface of the earth down to the formation. The well is then completed to open up the reservoir to production. As part of completion, a portion of the wellbore may be reinforced with a tubular casing. Various completions equipment may then be installed in the wellbore that will be used to produce the hydrocarbons in a controlled manner.

During completion, an isolation valve may be located downhole as part of a lower completions assembly, to isolate a formation pressure below the isolation valve. Additional equipment, such as an upper completions assembly, is installed above the isolation valve. Once the well is completed, the isolation valve may be subsequently operated to release pressure so that formation fluids can be produced to the surface. However, it can be challenging to reliably control a downhole tool such as an isolation valve from the surface of the earth.

BRIEF DESCRIPTION OF THE DRAWINGS

These drawings illustrate certain aspects of some of the embodiments of the present disclosure and should not be used to limit or define the method.

DETAILED DESCRIPTION

An apparatus and method are disclosed that can be used to actuate a downhole tool using a linear escapement mechanism. A linear escapement mechanism may comprise an escapement sleeve, including a plurality of escapement teeth. A rocker is operable to alternately engage the escapement sleeve with opposing pallets on the rocker to provide a controlled, incremental release of the escapement sleeve. The escapement sleeve is directly or indirectly coupled to the tool to be actuated. A finite and predictable number of oscillations of the rocker will thereby allow the escapement sleeve to advance to actuate the tool. Examples are discussed primarily in the context of opening and/or closing a subterranean valve, such as an isolation valve in a completions string. However, the actuating mechanisms and methods described herein could alternatively be used to actuate other tools, such as lubricator valves or plugging devices as non-limiting examples.

Aspects of the disclosure further include actuating such a downhole tool using an action taken at the surface, such as pressure cycling down in an annulus or through a tubing string. Alternatively, the pressure source for operating the actuator could be provided downhole such as an enclosed hydraulic pressure system. This may allow a downhole tool located deep underground to be reliably controlled from the surface of the wellsite.

Unlike certain conventional tools, the linear escapement mechanism provide a very predictable actuation so that an operator may be confident that a certain number of pressure cycles above a sufficient threshold will actuate the downhole tool. For example, the escapement may advance the escapement sleeve one tooth spacing per pressure cycle. The escapement sleeve may be configured with a predetermined number of teeth to advance to complete the actuation, so that the actuation is performed in response to a corresponding number of pressure cycles. A related benefit of this escapement mechanism is that an adjustment can be made which sets the escapement into an intermediate position, allowing the actuator to be reset without dismantling the tool. This will be particularly useful during testing.

Figure 1:
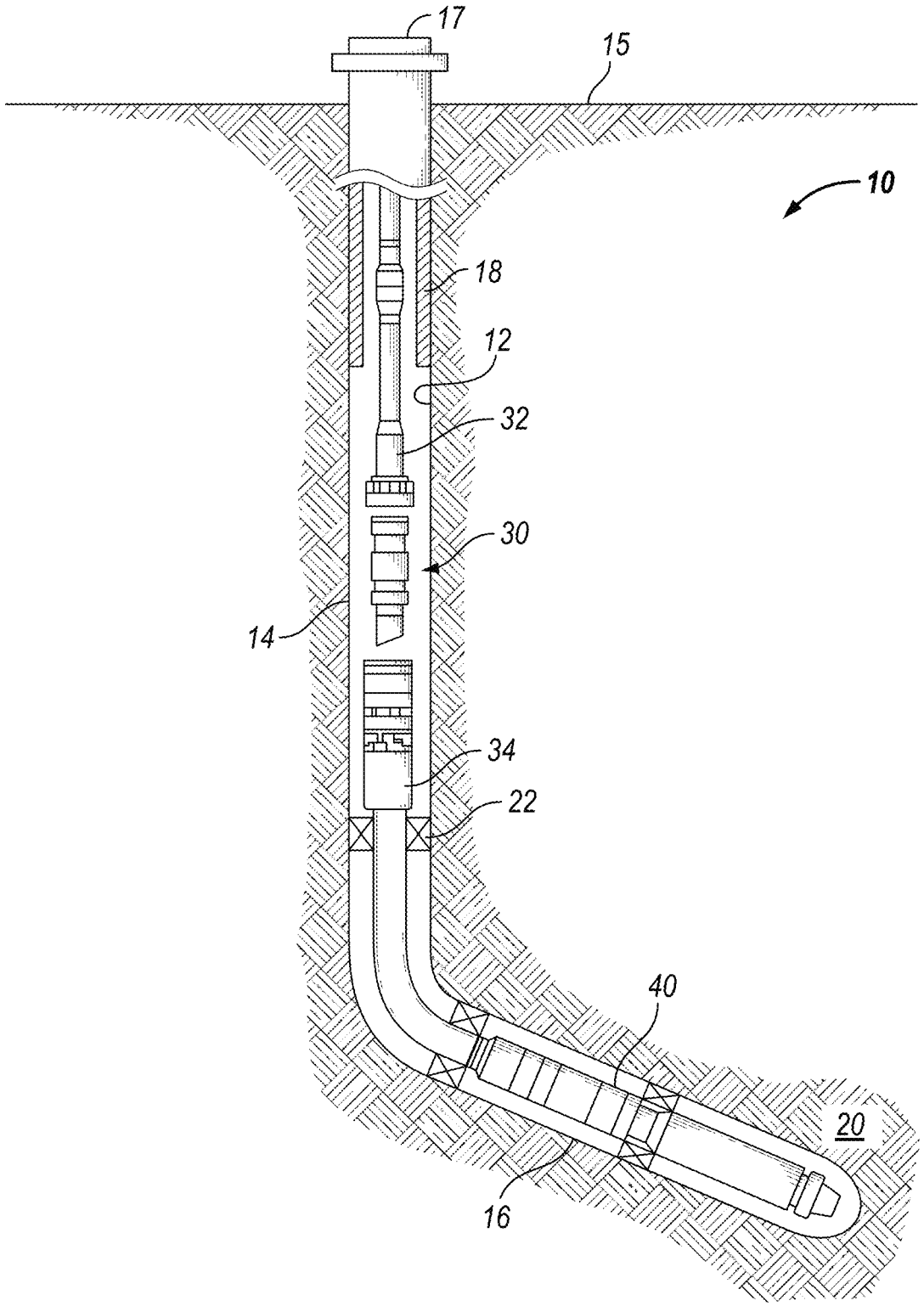
FIG. 1 is an elevation view of a representative hydrocarbon recovery well in which a downhole tool may be actuated according to aspects of this disclosure.

FIG. 1 is an elevation view of a representative hydrocarbon recovery well 10 as an example environment in which a downhole tool may be actuated according to aspects of this disclosure. The well 10 as depicted in FIG. 1 is simplified for discussion purposes, and is not to scale. The figure can represent land-based (i.e., onshore) operations or offshore operations. The well 10 includes a wellbore 12 drilled below a surface 15 of the well site through various earth strata in an underground formation 20. The surface 15 may represent the ground around a well-site in the context of land-based operations or a seabed in the context of offshore operations.

The wellbore 12 may follow any given wellbore trajectory, using available directional drilling techniques if necessary, to reach a desired hydrocarbon-bearing portion of the formation 20. By way of example, the wellbore 12 in FIG. 1 includes a vertical wellbore portion 14 and a deviated wellbore portion 16 extending below it. A portion of the wellbore 12 may be reinforced with a tubular metal casing 18 cemented in place. Other, uncased portions of the wellbore 12 may be referred to as open-hole.

A variety of tubular strings are used in the construction, operation, and maintenance of the well 10 over its useful service life, as well as to responsibly shut in or repurpose the well at the end of its useful service life, such as for underground storage of $CO_2$. A tubular string including tubing for conveying fluids and tools for performing wellbore operations. A tubular string may be constructed to any required length as its long, tubular shape allows it to be lowered into a desired depth in a wellbore. FIG. 1 depicts an example of a tubular string referred to as a completion string 30, which will be used for conveying hydrocarbons to a well head 17 at the surface 15 and/or to inject fluids into the formation 20. The completion string 30 may include a lower completion string 34 installed downhole and an upper completion string 32 that may be lowered into the well 10 for connecting with the lower completion string 34. Any number of packers 22 or other wellbore sealing elements may be used to fluidically isolate different portions of an annulus between the completion string 30 and the wellbore 12.

The lower completion string 34 includes at least one actuatable downhole tool 40 incorporated within the lower completion string 34. The downhole tool 40 may comprise a fluid control device, such as an isolation valve to control the flow of fluids from the surrounding formation 20 up the completion string 30. The isolation valve may be used, for instance, to isolate the wellbore 12 from the surrounding formation 20 prior to installing the upper completion string 32 to the lower completion string 34. The downhole tool 40 may also comprise an actuator having a linear escapement mechanism for actuating the isolation valve. Example configurations of such an actuator and linear escapement mechanism are discussed below in relation to subsequent figures.

Figure 2:
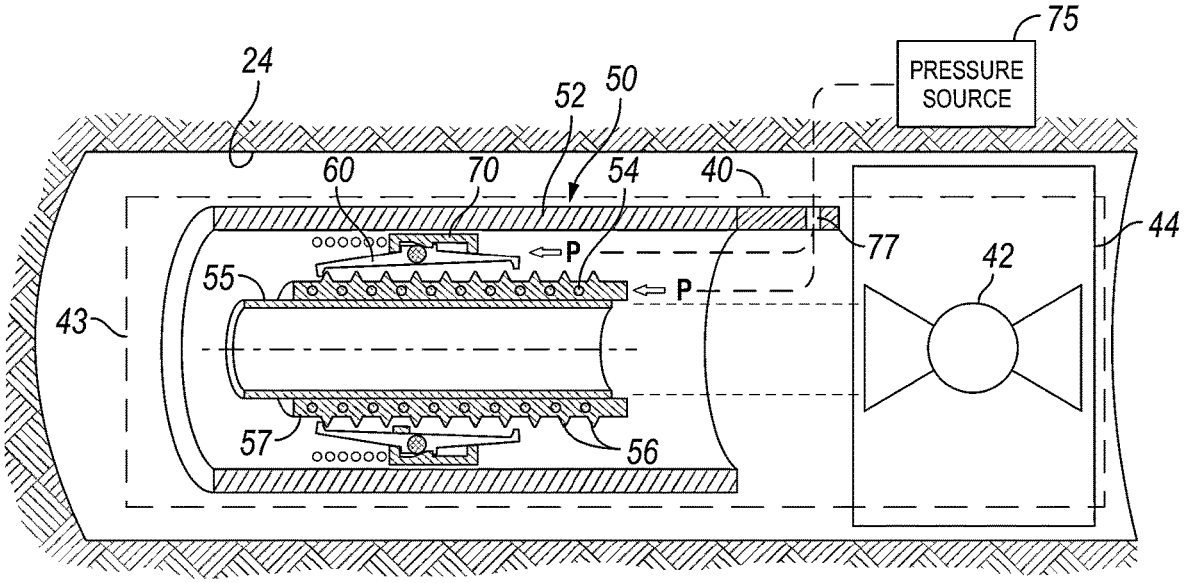
FIG. 2 is a schematic side view of the downhole tool according to an example configuration.

FIG. 2 is a schematic side view of a well control system 100 according to an example configuration. The well control system 100 includes the downhole tool 40 and a tool actuator 50. The downhole tool comprises an isolation valve 42 actuatable to open and/or close the isolation valve 42. The downhole tool 40 is shown disposed inside a tubular space 24, which may represent an inner wall of a wellbore, casing, or other tubular environment, about the downhole tool 40. The downhole tool 40 includes an uphole end 43 such as for coupling to tubular string components uphole of the downhole tool 40 and a downhole end 44 such as for coupling tubular string components downhole of the downhole tool 40. The isolation valve 42 and the actuator 50 may be in a shared housing or the isolation valve 42 and actuator 50 could have separate housings for incorporation into a tubular string. In either case, the actuator 50 is coupled to the isolation valve 42 for actuating the isolation valve 42 to open or close the isolation valve 42 or to adjust flow using the isolation valve 42.

The actuator 50 includes an actuator housing 52, which is tubular in this example, and can be any structure that houses, protects, or otherwise supports actuator components. The linear escapement components, at least in this example, include an escapement sleeve 54, at least one rocker 60 (two are shown), and an operating sleeve 70 engageable with the rocker(s) 60. The escapement sleeve 54 is axially moveable with respect to the actuator housing 52 and has a plurality of axially-arranged escapement teeth 56. The escapement sleeve 54 may comprise a generally tubular structure. In this example, the escapement sleeve 54 has an optionally two-piece construction comprising an inner sleeve portion 55, which may be coupled to the isolation valve 42, and an outer sleeve portion 57 secured to the inner portion 55 and defining the escapement teeth 56. The inner sleeve portion 55 may provide a clean, uninterrupted through-bore, which may be advantageous for allowing objects such as intervention tools to pass unhindered if required. However, an escapement sleeve does not require separate inner and outer portions and could alternatively be a unitary sleeve on which escapement teeth are defined, such as in the form of annular rings whose cross-sectional shape defines the escapement teeth 56.

A hydraulic pressure source schematically indicated at 75 is available for various hydraulically operable components of the actuator 50. The pressure source 75 may comprise, for example, pressurized well fluid that may be selectively provided downhole to the tool actuator 50, such as in the annulus of the well or internally via production tubing of the completions string. Such fluid could be filtered by a tool and supplied via a flow port 77. Alternatively, the pressure source 75 may be a closed hydraulic system provided in the completion string for operating certain hydraulic components. In this example, the pressure source 75 may be used to supply fluid pressure to the escapement sleeve 54 and/or operating sleeve 70.

Figure 3:
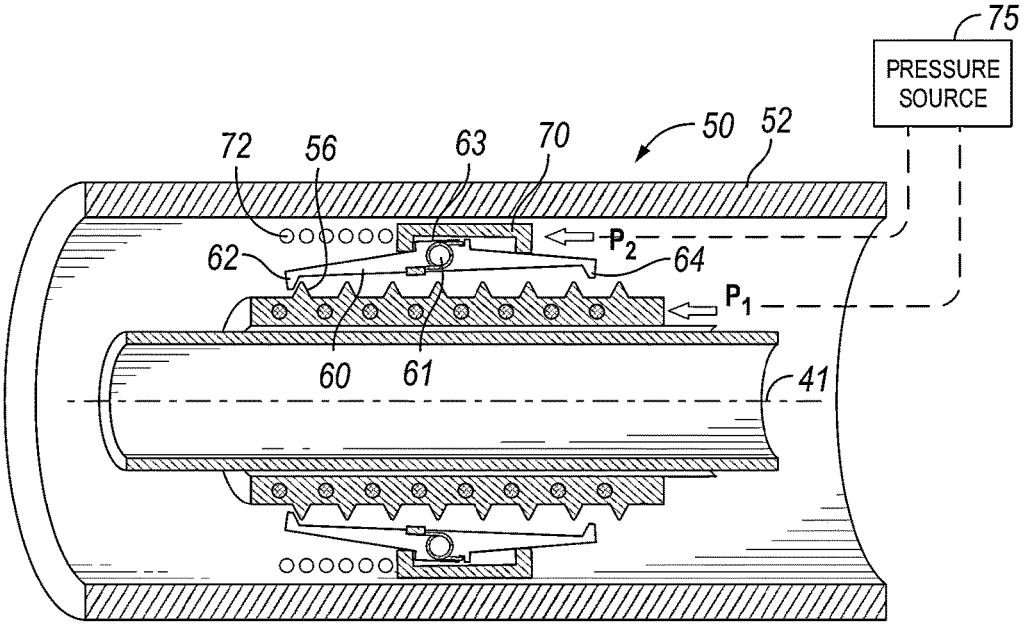
FIG. 3 is an enlarged view of the tool actuator of FIG. 2 further detailing the linear escapement mechanism.

The escapement sleeve 54 is moveable in at least one axial direction relative to the actuator housing 52, i.e., an actuation direction, to actuate the downhole tool 40. Actuating a downhole tool in this context generally entails changing a physical and/or operational state of the tool, such as to open or close a valve. In the example of FIG. 3, the isolation valve 42 may initially be in a closed position, in which case moving the escapement sleeve 54 in the actuation direction will open the isolation valve 42. Alternatively, the isolation valve 42 may initially be in the open position, in which case moving the escapement sleeve 54 in the actuation direction may close the isolation valve 42. An actuation direction may be toward and/or away from the tool being actuated. In this case, the actuation direction is axially away from the isolation valve 42. The escapement sleeve 54 is urged in the actuating direction such as by a hydraulic actuation pressure P1. As further discussed below, the escapement mechanism provides a controlled release of the escapement sleeve 54 as it advances axially in the actuating direction in response to the actuation pressure P1.

FIG. 3 is an enlarged view of the tool actuator 50 of FIG. 2 further detailing the linear escapement mechanism. The escapement mechanism includes at least one rocker 60 secured within the actuator housing 52 for releasing the escapement sleeve 54 in a controlled, incremental manner by rocking back and forth. This example shows two rockers 60 evenly circumferentially spaced about a tool axis 41. Examples may also include two or more axially spaced rockers (not expressly shown). Having more than one rocker 60 may be helpful, such as for redundancy or to provide a more uniform or balanced operation of the escapement sleeve 54. However, any number of rockers 60 could potentially be used within practical constraints, such as space requirements.

Each rocker 60 may be constrained in any suitable way to allow it to rock back and forth into engagement with the escapement sleeve 54. In this example, each rocker 60 is pivotably secured about a respective pivot member 61. Each rocker 60 includes a first pallet 62 and a second pallet 64 opposite one another with respect to the pivot member 61, to alternately engage escapement teeth 56 as the rocker 60 is rocked. The rocker 60 is rocked by reciprocation of the operating sleeve 70 in engagement with the rocker 60.

The operating sleeve 70 may alternatively be referred to as a reciprocating sleeve in that it may reciprocate to rock the rocker 60. Any suitable mechanism may be used to cause the operating sleeve 70 to reciprocate. In this example, the operating sleeve 70 is urged in one axial direction by an operating pressure P2 and biased back in an opposing, second axial direction by an axial biasing member 72 referred to as the sleeve spring in this example, such as a coil spring, liquid spring, or other type of spring. The axial biasing 72 member may alternatively be an opposing pressure source or any other suitable biasing member for biasing the operating sleeve 70 in the opposing, second axial direction. The rocker 60 may also be biased by a rocker spring 63, in this case in a clockwise direction about the pivot member 61. The operating sleeve 70 may be reciprocated by cycling pressure P2 above and below a threshold required to overcome the applicable biasing forces.

In the present example, the pressure source 75 may supply both the actuation pressure P1 and the operating pressure P2. In FIG. 3, the first pallet 62 is currently engaged with a respective one of the escapement teeth 56 while the opposing, second pallet 64 is disengaged from any of the escapement teeth 56. As illustrated, the operating pressure P2 is starting to be applied to the operating sleeve 70 to overcome the applicable biasing forces to start urging the operating sleeve 70 in the actuating direction (to the left in this case).

Figure 4:
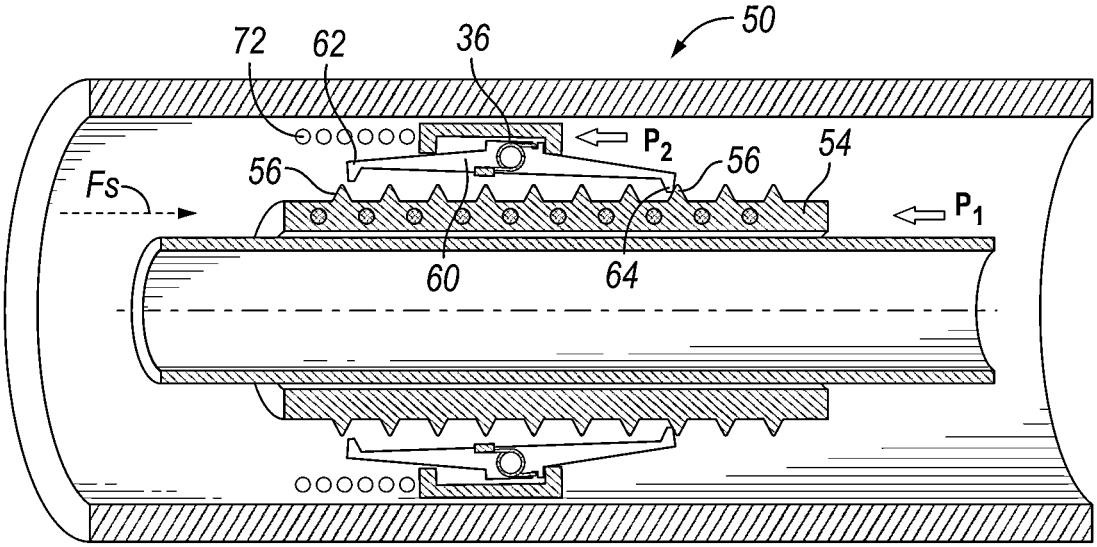
FIG. 4 is another enlarged view of the tool actuator after operating pressure has built up enough to urge the operating sleeve to the left.

FIG. 4 is another enlarged view of the tool actuator 50 after operating pressure P2 has built up enough to urge the operating sleeve 70 to the left, against the biasing action of any axial biasing member 72 and rocker spring 36. The operating sleeve 70 thus rocks the upper one of the two rockers 60 shown in one rotational direction, which happens to be clockwise in this example. The second pallet 64 has now engaged one of the escapement teeth 56 on the escapement sleeve 54 and the first pallet 62 has disengaged from another of the escapement teeth 56 that it was previously engaged with in FIG. 3. Accordingly, the escapement sleeve 56 has advanced an incremental distance in the actuation direction. The incremental distance may be equal to a tooth spacing between adjacent escapement teeth 56. The rocker 60 and escapement sleeve 54 may be configured (e.g., via geometry) such that the second pallet 64 engages or at least moves into an interference position with the respective escapement tooth 56 before the first pallet 62 disengages from the escapement tooth 56 it was engaged with, to help ensure the escapement sleeve 54 advances in a controlled and predictable manner in the actuation direction with each cycle of the rocker 60.

Figure 5:
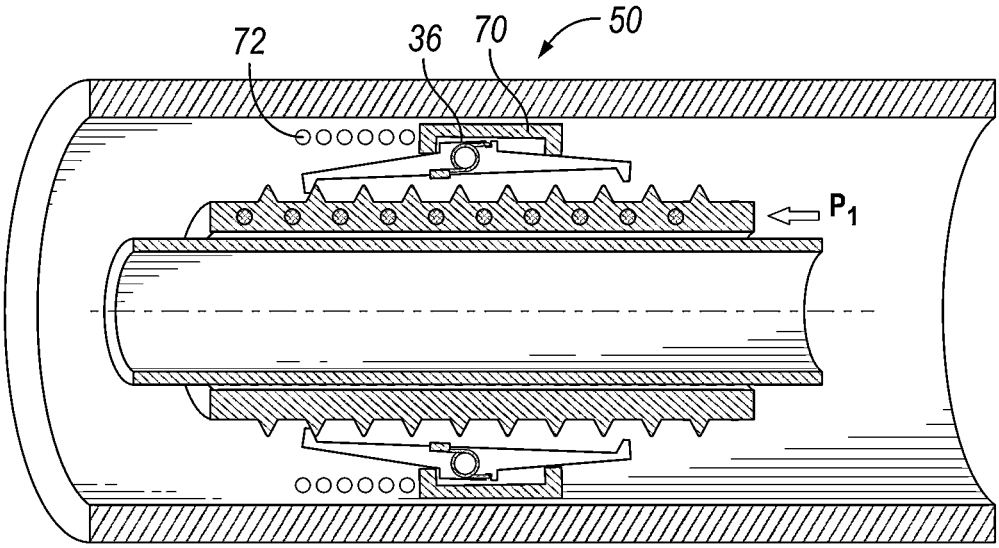
FIG. 5 is another enlarged view of the tool actuator after the operating sleeve has been urged back to the right in response to releasing or at least reducing the operating pressure.

FIG. 5 is another enlarged view of the tool actuator 50 after the operating sleeve 70 has been urged back to the right in response to releasing or at least reducing the operating pressure P2. Thus, the biasing action of the axial biasing member 72 and rocker spring 36 rock the upper one of the two rockers 60 shown in an anti-clockwise direction, back to the position of FIG. 3. The first pallet 62 has now engaged another one of the escapement teeth 56 on the escapement sleeve 54 and the second pallet 64 has disengaged from the escapement tooth 56 that it was previously engaged with in FIG. 4. Accordingly, the escapement sleeve 56 has advanced another incremental distance in the actuation direction. The incremental distance may be equal to another tooth spacing between adjacent escapement teeth 56.

Figure 6:
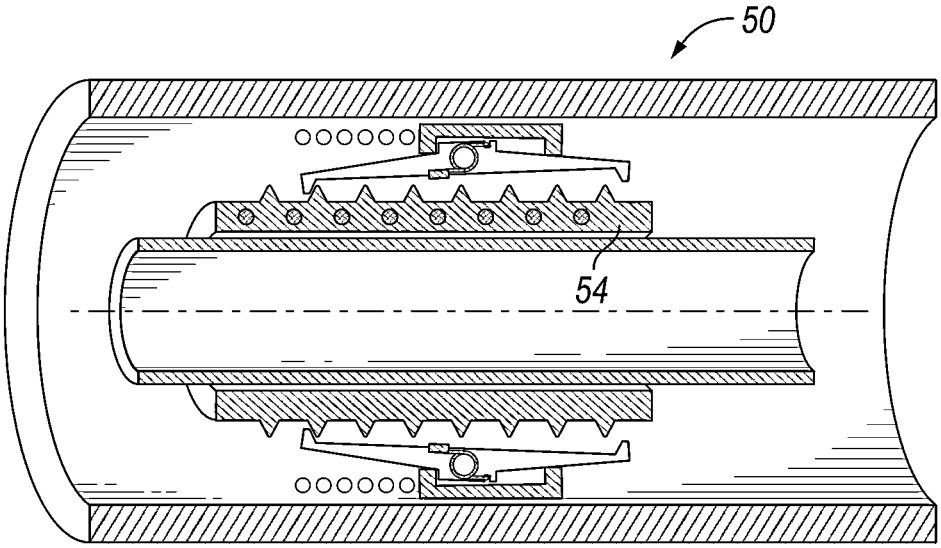
FIG. 6 is another enlarged view of the tool actuator in the position of FIG. 5, after the actuation pressure P1 has been released.

In FIG. 5, the actuation pressure P1 is still present on the escapement sleeve. FIG. 6 is another enlarged view of the tool actuator 50 in the position of FIG. 5, after the actuation pressure P1 has been released. The process may now be repeated as shown in the sequence from FIG. 3 to FIG. 6, to continue advancing the escapement sleeve in the actuation direction until the isolation valve or other tool has been actuated.

The escapement sleeve 54 may be reset at any time, if desired, after moving it to any extent in the actuating direction. For example, the operating sleeve 70 can be moved to an intermediate position. In this position, it will be possible to pull the release sleeve by virtue of the angled tooth profile of the escapement teeth 56. The geometry of the escapement teeth 56 may be adjusted from what is shown to facilitate the pallets alternately engaging and disengaging the escapement teeth 56. In response, the rocker 60 may rock back and forth to accommodate this movement.

Figure 7:
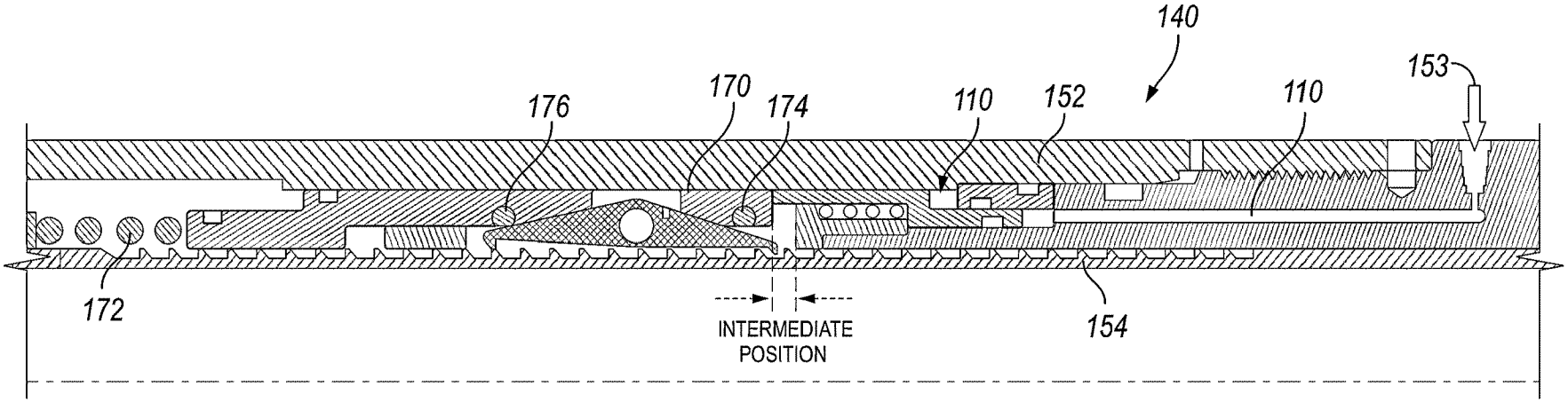
FIG. 7 is a sectional side view of an actuator according to another example configuration.

FIG. 7 is a sectional side view of an actuator 140 according to another example configuration. The actuator 140 includes an actuator housing 152 with a pressure port 153 that can be access prior to deployment to allow resetting if desired. Downhole, this pressure port 153 would typically be plugged. That pressure may be routed through the actuator housing 152 along a hydraulic flow path. The pressure supplies a piston 110 for driving the operating sleeve 170 in a first axial direction in response to the pressure applied to the piston 110 and a sleeve spring 172 for biasing the operating sleeve 170 in an opposing second axial direction. This positions the operating sleeve (170) into an intermediate position, whereby the escapement sleeve 154 can then be reversed to reset back to a first increment. The operating sleeve 170 includes first and second engagement members 174, 176 (e.g. rods or pins) positioned for engaging corresponding ramped surfaces of the rocker 160, so as to rock the rocker 160 back and forth as pressure is cycled from surface.

As in the previous embodiment, the escapement sleeve 154 may be reset, if desired, after moving it to any extent in the actuating direction. For example, the operating sleeve 170 can be moved to an intermediate position shown in FIG. 7, such as by locking in pressure to the piston 110 dedicated for this purpose. In this position, it will be possible to pull the release sleeve by virtue of the angled tooth profile of the escapement teeth 156. In response, the rocker 160 will rock back and forth to allow this to happen.

Figure 8:
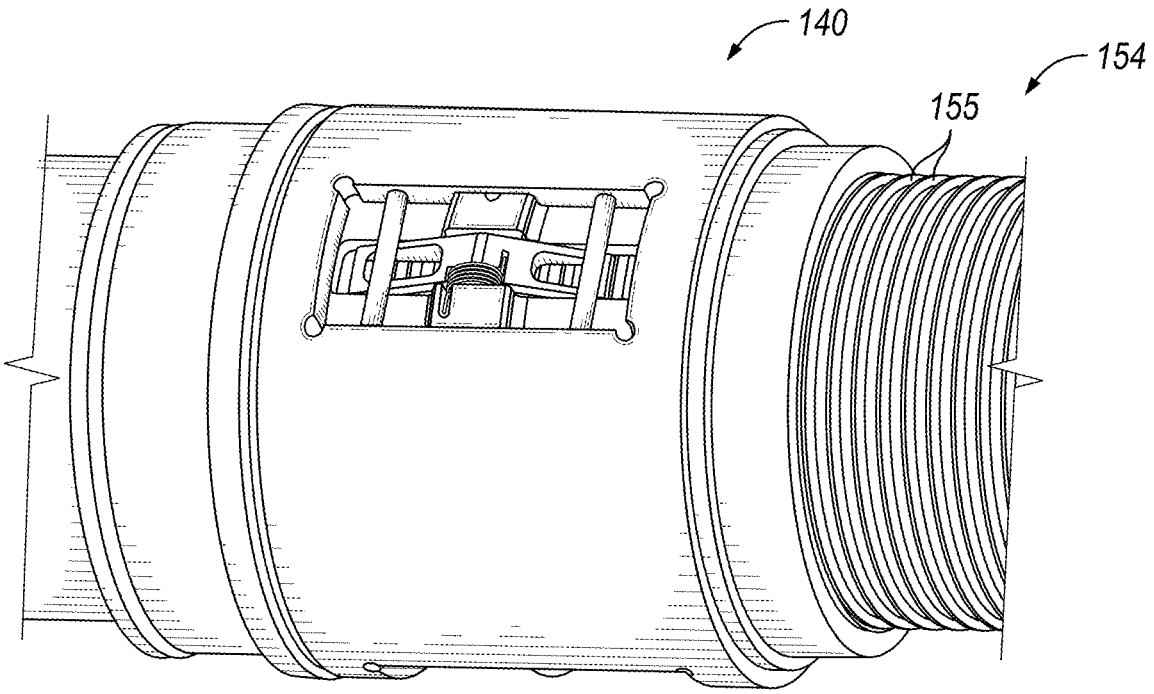
FIG. 8 is a perspective view of the actuator of FIG. 7.

FIG. 8 is a perspective view of the actuator 140 with a cutaway revealing one of the rockers 160. This view also shows a portion of the escapement sleeve 154 according to a configuration wherein the escapement teeth (FIG. 7) are defined by a plurality of annular rings 155. The annular rings 155 may be integrally formed on an exterior of the escapement sleeve 154 such as by machining into the outer diameter (OD) of the escapement sleeve 154. Thus, a cross-section of the annular rings 155 along a plane through a centerline of the escapement sleeve 154 may define a profile of the escapement teeth discussed above. The rocker 160 rocks back and forth to thereby engage the annular rings 155.

Figure 9:
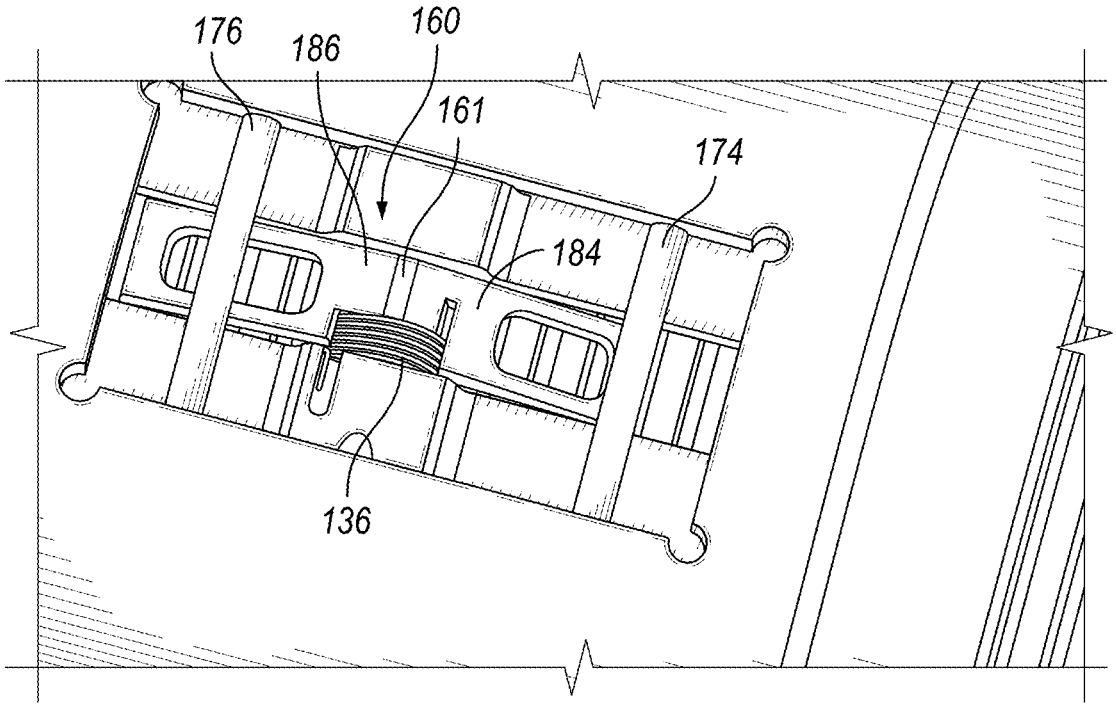
FIG. 9 is another partially cutaway exterior view of the actuator of FIG. 7, further detailing one of the rockers.

FIG. 9 is another partially cutaway exterior view of the actuator 140 showing one of the rockers 160. The rocker 160 comprises a first tapered surface 184 and an opposing second tapered surface 186 extending in opposing directions from the pivot member 161. The operating sleeve 170 carries the first engagement member 174 for engaging the first tapered surface 184 when the operating sleeve is urged in a first axial direction, to rotate the rocker 160 in a first rotational direction. The operating sleeve 170 also carries the second engagement member 176 for engaging the second tapered surface 186 when the operating sleeve is urged in a second axial direction opposite the first direction, to rotate the rocker 160 in a second rotational direction opposite the first rotational direction. An example location for the rocker spring 136 is also shown.

Accordingly, the present disclosure provides apparatus and method to acuate a downhole tool using a linear escapement mechanism. These may be embodied with any suitable combination of the various features disclosed herein, including but not limited to one or more of the following examples.

Example 1. An actuator for a downhole tool, the actuator comprising: an actuator housing; an escapement sleeve axially moveable with respect to the actuator housing and having a plurality of axially-arranged escapement teeth; a rocker secured within the actuator housing and having opposing first and second pallets; and an operating sleeve reciprocable to rock the rocker back and forth to alternately move the opposing first and second pallets into engagement with the escapement sleeve as the escapement sleeve advances axially in an actuating direction.

Example 2. The actuator of Example 1, further comprising a piston for driving the operating sleeve in a first axial direction in response to a pressure applied to the piston and an axial biasing member for biasing the operating sleeve in an opposing second axial direction, such that cycling the pressure to the piston drives reciprocation of the operating sleeve.

Example 3. The actuator of Example 2, further comprising a rocker spring for biasing the rocker in a first rotational direction.

Example 4. The actuator of Example 2 or 3, wherein the pressure applied to the piston is also applied to advance the escapement sleeve axially.

Example 5. The actuator of any of Examples 1 to 4, wherein the escapement sleeve comprises an array of annular rings that define the escapement teeth.

Example 6. The actuator of any of Examples 1 to 5, wherein the rocker comprises a first tapered surface and the operating sleeve comprises a first engagement member for engaging the first tapered surface when the operating sleeve is urged in a first axial direction to rotate the rocker in a first rotational direction.

Example 7. The actuator of Example 6, wherein the rocker comprises a second tapered surface opposite the first tapered surface and the operating sleeve comprises a second engagement member opposite the first engagement member for engaging the second tapered surface when the operating sleeve is urged in a second axial direction opposite the first direction to rotate the rocker in a second rotational direction opposite the first rotational direction.

Example 8. The actuator of Example 6 or 7, further comprising a rocker spring that biases the rocker in a second rotational direction opposite the first rotational direction.

Example 9. The actuator of any of Examples 1 to 8, wherein the pallets are arranged so that one of the pallets can only disengage from a respective one of the escapement teeth after the other pallet has engaged another one of the escapement teeth.

Example 10. The actuator of any of Examples 1 to 9, further comprising one or more additional rockers circumferentially spaced from the rocker within the actuator housing, each also having opposing first and second pallets, and wherein the operating sleeve rocks each of the one or more additional rockers back and forth to alternately move the opposing their respective first and second pallets into engagement with the escapement teeth as the escapement sleeve advances axially.

Example 11. A well system, comprising: a downhole tool; and an actuator comprising an actuator housing, an escapement sleeve axially moveable with respect to the actuator housing and having a plurality of axially-arranged escapement teeth, a rocker secured within the actuator housing and having opposing first and second pallets, and an operating sleeve reciprocable to rock the rocker back and forth to alternately move the opposing first and second pallets into engagement with the escapement teeth as the escapement sleeve advances axially to actuate the downhole tool.

Example 12. The well system of Example 11, wherein the downhole tool comprises a valve, and wherein the actuating the downhole tool comprises opening or closing the valve in response to axially advancing the escapement sleeve.

Example 13. The well system of Example 11 or 12, further comprising a piston for driving the operating sleeve in a first axial direction in response to a pressure and an axial biasing member for biasing the operating sleeve in an opposing axial direction, such that cycling the pressure to the piston drives reciprocation of the operating sleeve.

Example 14. The well system of Example 13, wherein the pressure applied to the piston is also applied to advance the escapement sleeve axially.

Example 15. The well system of any of Examples 11 to 14, wherein the escapement sleeve comprises an array of annular rings that define the escapement teeth.

Example 16. The well system of any of Examples 11 to 15, wherein the rocker comprises a first tapered surface and the operating sleeve comprises a first engagement member for engaging the first tapered surface when the operating sleeve is urged in a first axial direction to rotate the rocker in a first rotational direction.

Example 17. The well system of Example 16, wherein the rocker comprises a second tapered surface and the operating sleeve comprises a second engagement member for engaging the second tapered surface when the operating sleeve is urged in a second axial direction opposite the first direction to rotate the rocker in a second rotational direction opposite the first rotational direction.

Example 18. The well system of Example 16 or 17, further comprising a rocker spring that biases the rocker in a second rotational direction opposite the first rotational direction.

Example 19. A method of actuating a downhole tool, the method comprising: advancing an escapement sleeve axially with respect to an actuator housing; and using an operating sleeve to rock a rocker back and forth to alternately move opposing first and second pallets on the rocker into engagement with a plurality of axially-arranged escapement teeth on the escapement sleeve to control the advancing of the escapement sleeve axially.

Example 20. The method of Example 19, further comprising disengaging one of the pallets from a respective one of the escapement teeth only when the other pallet is in engagement with another one of the escapement teeth.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. An actuator for a downhole tool, the actuator comprising:

an actuator housing;

an escapement mechanism comprising an escapement sleeve and a plurality of escapement teeth, wherein the escapement mechanism advances the escapement sleeve one tooth spacing per pressure cycle; and a rocker secured within the actuator housing and having opposing first and second pallets, wherein the rocker is operable to alternatively engage the escapement sleeve with the opposing first and second pallets.

2. The actuator of claim 1, further comprising an operating sleeve reciprocable to rock the rocker back and forth to alternatively move the opposing first and second pallets into engagement with the escapement sleeve.

3. The actuator of claim 2, further comprising a piston for driving the operating sleeve in a first direction in response to a pressure applied to the piston and a biasing member for biasing the operating sleeve in an opposing second axial direction, such that cycling the pressure to the piston drives reciprocation of the operating sleeve.

4. The actuator of claim 3, further comprising a rocker spring for biasing the rocker in a first rotational direction.

5. The actuator of claim 3, wherein the pressure applied to the piston is also applied to advance the escapement sleeve.

6. The actuator of claim 2, wherein the rocker comprises a first tapered surface and the operating sleeve comprises a first engagement member for engaging the first tapered surface when the operating sleeve is urged in a first direction to rotate the rocker in a first rotational direction.

7. The actuator of claim 6, wherein the rocker comprises a second tapered surface opposite the first tapered surface and the operating sleeve comprises a second engagement member opposite the first engagement member for engaging the second tapered surface when the operating sleeve is urged in a second direction opposite the first direction to rotate the rocker in a second rotational direction opposite the first rotational direction.

8. The actuator of claim 6, further comprising a rocker spring that biases the rocker in a second rotational direction opposite the first rotational direction.

9. The actuator of claim 2, wherein the pallets are arranged so that one of the pallets can only disengage from a respective one of an escapement teeth after the other pallet has engaged another escapement teeth.

10. The actuator of claim 2, further comprising one or more additional rockers circumferentially spaced from the rocker within the actuator housing, each also having opposing first and second pallets, and wherein the operating sleeve rocks each of the one or more additional rockers back and forth to alternately move the opposing their respective first and second pallets into engagement with the escapement teeth as the escapement sleeve advances in an actuating direction.

11. The actuator of claim 1, wherein the escapement sleeve comprises an array of annular rings that define the escapement teeth.

12. A well system, comprising:

a downhole tool; and an actuator comprising:

an actuator housing, an escapement mechanism within the actuator housing, wherein the escapement mechanism comprises an escapement sleeve and a plurality of escapement teeth, wherein the escapement mechanism advances the escapement sleeve one tooth spacing per pressure cycle and a rocker secured within the actuator housing and having opposing first and second pallets, wherein the rocker is operable to alternatively engage the escapement sleeve with the opposing first and second pallets.

13. The well system of claim 12, further comprising an operating sleeve reciprocable to rock the rocker back and forth to alternatively move the opposing first and second pallets into engagement with the escapement sleeve.

14. The well system of claim 13, wherein the downhole tool comprises a valve, and wherein the actuating the downhole tool comprises opening or closing the valve in response to advancing the escapement sleeve.

15. The well system of claim 13, further comprising a piston for driving the operating sleeve in a first direction in response to a pressure and a biasing member for biasing the operating sleeve in an opposing direction, such that cycling the pressure to the piston drives reciprocation of the operating sleeve.

16. The well system of claim 15, wherein the pressure applied to the piston is also applied to advance the escapement sleeve.

17. The well system of claim 13, wherein the rocker comprises a first tapered surface and the operating sleeve comprises a first engagement member for engaging the first tapered surface when the operating sleeve is urged in a first direction to rotate the rocker in a first rotational direction.

18. The well system of claim 17, wherein the rocker comprises a second tapered surface and the operating sleeve comprises a second engagement member for engaging the second tapered surface when the operating sleeve is urged in a second direction opposite the first direction to rotate the rocker in a second rotational direction opposite the first rotational direction.

19. The well system of claim 13, further comprising a rocker spring that biases the rocker in a second rotational direction opposite the first rotational direction.

20. The well system of claim 12, wherein the escapement sleeve comprises an array of annular rings that define the escapement teeth.

* * * * *